United States Patent [19]

Parmentar et al.

[11] Patent Number: 4,664,315

[45] Date of Patent: May 12, 1987

[54] ELECTROSTATIC SPRAY NOZZLE

[75] Inventors: William F. Parmentar, Vermilion; Gary E. Burls, Amherst, both of Ohio

[73] Assignee: Parker Hannifin Corporation, Cleveland, Ohio

[21] Appl. No.: 819,238

[22] Filed: Jan. 15, 1986

[51] Int. Cl.[4] ..... B05B 5/00; B05B 7/10

[52] U.S. Cl. ..... 239/706; 239/690; 239/402; 239/403; 239/405

[58] Field of Search ..... 239/3, 690, 691, 693, 239/703–706, 708, 403, 402, 405

[56] References Cited

U.S. PATENT DOCUMENTS

| | | | |
|---|---|---|---|
| 1,219,642 | 3/1917 | Isaacs | 239/300 |
| 2,302,185 | 11/1942 | Campbell, Jr. | 48/38 |
| 2,302,289 | 11/1942 | Bramston-Cook | 21/2 |
| 2,784,351 | 3/1957 | Renner | 239/697 X |
| 2,984,420 | 5/1961 | Hession | 239/403 X |
| 3,195,264 | 7/1965 | Ward, Jr. | 43/148 |
| 3,212,211 | 10/1965 | Bennett | 43/148 |
| 3,217,986 | 11/1965 | Davis | 239/403 |
| 3,248,606 | 4/1966 | Fraser | 239/3 X |
| 3,335,943 | 8/1967 | Sorrenti | 230/127 |
| 3,339,840 | 9/1967 | Point | 239/3 |
| 3,398,893 | 8/1968 | Missimer et al. | 239/77 |
| 3,401,883 | 9/1968 | Gebhardt et al. | 239/690 X |
| 3,489,351 | 1/1970 | Patterson | 239/77 |
| 3,516,608 | 6/1970 | Bowen et al. | 239/706 |
| 3,517,888 | 6/1970 | Mitterer | 239/579 |
| 3,670,963 | 6/1972 | Stroebel et al. | 239/77 |
| 3,698,635 | 10/1972 | Sickles | 239/3 |
| 3,747,850 | 7/1973 | Hastings et al. | 239/3 |
| 3,802,625 | 4/1974 | Buser et al. | 239/704 |
| 3,917,168 | 11/1975 | Tenney | 239/13 |
| 4,004,733 | 1/1977 | Law | 239/3 |
| 4,341,347 | 7/1982 | DeVittorio | 239/3 |
| 4,401,274 | 8/1983 | Coffee | 239/690 |
| 4,433,003 | 2/1984 | Gourdine | 239/3 X |
| 4,508,265 | 4/1985 | Jido | 239/3 |
| 4,509,694 | 4/1985 | Inculet et al. | 239/697 |
| 4,527,745 | 7/1985 | Butterfield et al. | 239/600 |

*Primary Examiner*—Andres Kashnikow

*Attorney, Agent, or Firm*—Christopher H. Morgan

[57] ABSTRACT

An electrostatic nozzle assembly for coating row crops and other plants with electrostatically charged particles of pesticide including a nozzle body formed with passageways to receive air and a grounded stream of waterborne pesticide for delivery through a nozzle tip to an inductor ring mounted between the nozzle body and an air nozzle having a discharge orifice. As the stream of waterborne pesticide is projected from the nozzle tip, it is impacted with a swirling, spirally moving stream of air produced by a swirl plate having a plurality of tapered air channels oriented tangentially relative to the pesticide stream and communicating with the air passageway in the nozzle body. The inductor ring inductively charges the pesticide in the terminal end of the nozzle tip. The swirling air stream atomizes the charged pesticide stream expelled from the nozzle tip into finely divided particles, and then imparts the swirling motion to the charged particles which fan radially outwardly in a wide spray pattern when ejected from the discharge orifice in the air nozzle. An electrical standoff is also provided by forming the air nozzle with an irregularly-shaped outer surface which lengthens the electrical path which charged particles collected on the air nozzle would have to travel to migrate to the grounded support for the nozzle body or the nearest grounded point.

16 Claims, 3 Drawing Figures

ELECTROSTATIC SPRAY NOZZLE

BACKGROUND OF THE INVENTION

This invention relates to electrostatic spraying devices, and, more particularly, to a low voltage electrostatic spraying device in which a stream of electrostatically charged pesticide is dispersed in a wide spray pattern upon the objects to be coated, and electrical hazards of isolating the material supply are reduced.

Electrostatic coating is a process in which a stream of coating material is atomized into finely divided particles which are electrostatically charged. The charged particles are then directed at a surface to be coated which is held at a different electrical potential than the particles. Due to the electrostatic attraction and the proximity of the charged particles to the surface to be coated, electrostatic forces move the particles onto the surface where they are deposited to form a coating or layer.

Many electrostatic coating devices employ high voltages, e.g., 50 kilovolts or more, to create a corona discharge through which the particles pass to become electrostatically charged. One problem with employing high voltages in the application of electrostatic charges to waterborne pesticides for deposition onto trees or other crops, is that waterborne pesticides are highly conductive and the charge applied thereto is transferred back through the pesticide stream to its holding tank. The tank must therefore be electrically isolated from ground. When isolated, the tank becomes charged with the same high voltage as the electrical field, and must be electrically insulated and isolated from the persons spraying the pesticide to avoid serious electrical hazards. Special insulation and mounting of the holding tank of a pesticide sprayer adds substantially to its costs, and therefore the use of corona electrostatic charging of waterborne pesticides has been traditionally cost prohibitive and dangerous.

An electrostatic spraying device for agricultural applications which employs low voltage to inductively charge a stream of waterborne pesticides or similar treatment chemicals is shown, for example, in U.S. Pat. No. 4,004,733 to Law. Electrostatic spray nozzles of this general type comprise a nozzle body formed with a fluid passageway in which a stream of waterborne pesticide is atomized into finely divided droplets or particles. An electrode is mounted in the nozzle body, in axial alignment with the fluid passageway, which is operable to electrostatically charge the particles forming the atomized stream before they exit the nozzle body. The electrostatic charge is applied to the fluid stream at the point of atomization by induction using a voltage on the order of 2 kilovolts, as opposed to ionized field systems which typically employ voltages of 50 kilovolts to 100 kilovolts or higher. The charged particles which are entrained in the stream of air are then expelled through the fluid passageway in the nozzle body, which propels the charged particles onto the trees, grapevines or row crops to be coated.

One limitation of spray devices such as disclosed in U.S. Pat. No. 4,004,733 to Law, is that it produces a narrow spray pattern. Another limitation of electrostatic spray devices of the type described in the Law patent involves the problem of grounding the electrode to the point at which the dielectric nozzle body is connected to ground potential. Charged particles emitted from the discharge orifice accumulate on the exterior surface of the nozzle body near the discharge orifice, and readily migrate along the nozzle body eventually reaching its connection to ground. Grounding of the electrode via the thin film of particles formed along the nozzle body and emitted from the discharge orifice reduces the charging efficiency of the electrode and limits the effectiveness of the spray device in completely coating the target trees or other crops. Yet another limitation of the prior art devices is that they do not comprise multiple component assemblies wherein the key components can be easily disassembled and reassembled for maintenance, repair and replacement of worn or defective parts.

SUMMARY OF THE INVENTION

It is therefore among the objects of this invention to provide safe electrostatic spray apparatus for pesticides which affords a wide spray pattern of electrostatically charged particles for deposition onto trees or other crops to be coated, and which avoids grounding of the electrode which imparts the electrostatic charge to the pesticide to maintain high charging efficiency by means of a nozzle assembly which is easily maintained and repaired.

These objectives are accomplished according to this invention by providing an inductive spray device with means to impart a spiral, swirling motion to the atomizing air stream. The swirling, substantially spiral motion of the air stream, and the charged particles entrained therein, produces a wide spray pattern since the electrostatically charged particles tend to continue to rotate after they exit the discharge orifice and thus quickly fan radially outwardly in a wide pattern toward the object to be coated. In accordance with further principles of this invention, the outer surface of the nozzle assembly near the discharge orifice is formed with an irregular shape to lengthen the electrical path between electrostatically charged particles ejected from the discharge orifice, and the point at which the nozzle body of the spray device is connected to ground. The invention, moreover, comprises a multiple component assembly wherein the components are releasably secured together and can be easily disassembled for maintenance and repair, or replacement of key components.

More specifically, the electrostatic nozzle assembly herein includes a nozzle body having an air passageway, a liquid passageway and an electrical passageway connected to a source of relatively low electrical potential. An air nozzle formed with a discharge orifice is mounted at one end of the nozzle body by a nozzle nut. An electrode in the form of an inductor ring having an aperture is mounted between the air nozzle and nozzle body so that its aperture axially aligns with the discharge orifice in the air nozzle. The inductor ring is connected through the electrical passageway to the source of electrical potential so as to create an electrostatic field across its aperture.

In one aspect of this invention, a stream of waterborne pesticide, held at or near ground potential, is directed into the aperture of the inductor ring where it is atomized into finely divided particles by a swirling, substantially spirally moving stream of air. A flow path of the stream of waterborne pesticide to the inductor ring, and atomization of the stream thereat, is provided by a swirl plate in accordance with this invention which is disposed between the inductor ring and nozzle body.

In a presently preferred embodiment the swirl plate is formed with a tapered central bore communicating with the liquid passageway formed in the nozzle body. The tapered central bore terminates at a nozzle tip having an outlet disposed approximately midway into the aperture of the inductor ring. Waterborne pesticide is thus directed from the liquid passageway, to the tapered central bore and through the outlet in the nozzle tip into the aperture of the inductor ring.

The swirl plate is also formed with a plurality of atomizing air channels which communicate with the air passageway and atomize the stream of waterborne pesticide discharged into the aperture of the inductor ring by the nozzle tip. In a presently preferred embodiment, the channels each extend radially outwardly from the nozzle tip of the central bore, substantially tangentially thereto, and terminate at an annular groove formed in the swirl plate which communicates with the air passageway. The channels preferably are tapered and decrease in cross section from the annular groove to the nozzle tip. Air introduced into the annular groove through the air passageway is directed by the channels along flow paths which are substantially tangent to the nozzle tip of the central bore and the stream of waterborne pesticide discharged therefrom. A swirling, spirally moving air stream is therefore created by the channels at the outlet of the nozzle tip which is accelerated by the tapered channels toward the nozzle tip and contacts the stream of waterborne pesticide at its highest velocity thereat to form finely divided droplets or particles.

Preferably, the nozzle tip of the central bore is disposed within the aperture of the inductor ring so that the waterborne pesticide stream is atomized by the swirling air stream in the presence of the electrostatic field created by the inductor ring. An induced electrostatic charge is imparted to each particle by the inductor ring for deposition upon the article to be coated.

One advantage of this invention is that the electrostatically charged particles become entrained within the swirling, spirally moving air stream which imparts that same motion to the charged particles. Once expelled from the discharge orifice of the air nozzle, the charged particles tend to continue to move with the same swirling, spiral motion and therefore fan radially outwardly from the discharge orifice to form a wide angle spray pattern for deposition onto the trees, vines or row crops to be coated. It is contemplated that in some applications, fewer electrostatic nozzle assemblies according to this invention would be needed to achieve the same coverage of pesticide on the target trees or crops, as compared to prior art spray nozzles.

In addition to the atomization of the pesticide stream and swirling motion imparted to the charged particles of pesticide which produces a desirably wide pattern, the air stream produced by the swirl plate of this invention creates an air barrier between the inductor ring and the waterborne pesticide. If the inductor ring became wetted with a film of the waterborne pesticide, a conductive path from the inductor ring to ground via the pesticide stream could be created which would cause the inductor ring to become grounded and ineffective in charging the atomized particle stream. The air barrier created by the swirling stream of air from the swirl plate is therefore important in maintaining the inductor ring and adjacent housing dry.

In another aspect of this invention, the electrical standoff which is provided between the discharge orifice of the air nozzle and the grounded bracket which mounts the nozzle body is achieved by providing the air nozzle with an annular wall which extends outwardly from the discharge orifice forming a cavity into which the charged particle stream is discharged. The exterior of the annular wall includes a number of grooves which form an irregular-shaped outer surface having a plurality of ridges and recesses.

In normal operation of the nozzle assembly herein, some of the charged particles emitted from the discharge orifice can collect on the wall of the air nozzle and will tend to migrate toward the grounded bracket. The ridges and recesses form an extended or lengthened path which impedes movement of the charged particles along the wall of the air nozzle to the bracket which grounds the nozzle body. This extended or lengthened path mechanically impedes the flow of particles along the electric field lines, effectively lengthening the electrical standoff between the discharge orifice and grounded bracket without increasing the overall physical length of the air nozzle or nozzle body.

Preferably, the wall of the air nozzle is also formed with an inner surface having a taper which increases in cross section as it extends outwardly from the discharge orifice. It has been found that such tapered surface tends to collect charged particles emitted from the discharge orifice and causes them to drip off of the air nozzle before the charged particles can migrate to the outer surface of the air nozzle wall. It is believed that this occurs because of the shape of the electric field lines produced by the charged particles emitted from the discharge orifice.

DESCRIPTION OF THE DRAWINGS

The structure, operation and advantages of a presently preferred embodiment of this invention will become further apparent upon consideration of the following description taken in conjunction with the accompanying drawings, wherein.

DETAILED DESCRIPTION OF THE INVENTION

Figure 1:
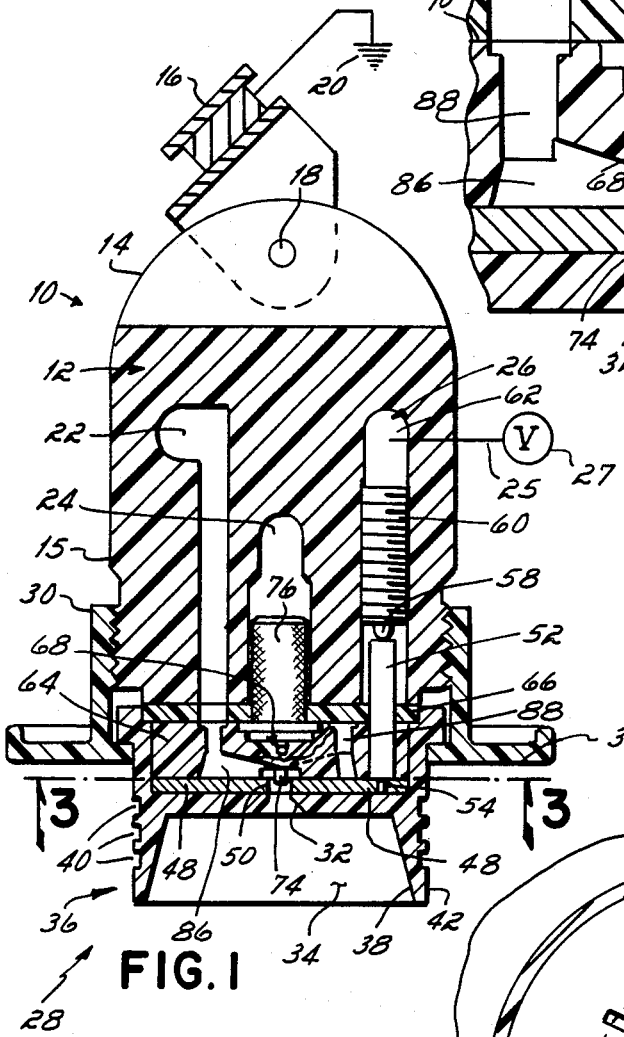
FIG. 1 is a side elevational view in partial cross section of an electrostatic nozzle assembly in accordance with this invention.

Referring now to the drawings, an electrostatic nozzle assembly 10 according to this invention includes a nozzle body 12 having a yoke 14 at its upper end which receives a mounting bracket 16 connected thereto by a pin 18. The bracket 16 is grounded as at 20 and its pin connection to the yoke 14 allows the nozzle body 12 to be pivoted with respect to the bracket 16.

The nozzle body 12 is formed of dielectric material and includes an air passageway 22, a liquid passageway 24 and an electrical passageway 26 all of which extend from the base 13 of nozzle body 12 toward the yoke 14. Suitable hoses (not shown) connect sources of air, and liquid in the form of waterborne pesticide, to the air and liquid passageways 22, 24, respectively. An electrical cable 25 from a source of relatively low voltage 27 is connected to the nozzle body 12 at the electrical passageway 26.

Mounted at the base 13 of nozzle body 12 is an air nozzle 28 formed of dielectric material. The air nozzle 28 is secured in place by a nozzle nut 30, also formed of dielectric material, having a radial flange 31 and internal threads which are adapted to threadedly engage external threads formed on the outer surface 15 of nozzle body 12. In a presently preferred embodiment, the air nozzle 28 is formed with a conical-shaped discharge orifice 32 which terminates within a cavity 34 defined by an annular wall 36. The annular wall 36 has an inner surface 38 formed in a generally frusto-conical shape which increases in cross section from the discharge orifice 32 outwardly relative to the axis of the discharge orifice 32. The exterior of the annular wall 36 is formed with grooves 40 forming an outer surface 42 of irregular shape having a plurality of recesses and ridges.

An electrode in the form of an inductor ring 48 having a central aperture 50 rests atop the air nozzle 28 so that the aperture 50 axially aligns with the discharge orifice 32 in the air nozzle 28. The inductor ring 48 is preferably formed of an electrically conductive material which does not corrode in the presence of liquid pesticide or similar chemicals. A relatively low voltage, preferably on the order of about 1,000 volts, is applied to the inductor ring 48 to create an electrostatic field across its aperture 50.

Electrical potential is applied to the inductor plate 48 through the electrical passageway 26 which contains the following elements. A pin 52 disposed at the base of the electrical passageway 26 has a tip 54 mounted to the inductor plate 48. The upper end of pin 52 is formed with a contact 58 which engages a spring-biased plunger 60, commercially available from Jurgens, Inc. of Cleveland, Ohio under Part No. 27226. The plunger 60 is disposed between the pin 52 and a slug 62 mounted within the uppermost portion of the electrical passageway 26. The slug 62 is a section of electrically conductive material which connects directly to the electrical cable 25 from the source 27 of electrical potential. The slug 62, plunger 60 and pin 52 together provide an electrical path from the source 27 to the inductor plate 48. The spring-biased plunger 60 maintains the elements in electrical contact with one another to ensure that the inductor plate 48 is constantly charged.

The electrostatic nozzle assembly 10 of this invention is operable to atomize a stream of waterborne pesticide into finely divided particles, electrostatically charge the particles and propel the charged particles onto the plants or crops to be coated through the discharge orifice 32 of air nozzle 28. The liquid stream is directed to the inductor ring 48, charged, atomized and then carried away by a stream of swirling air formed by a swirl plate 64. The swirl plate 64 is made of dielectric material and is positioned directly atop the inductor plate 48 and is separated from the base 13 of nozzle body 12 by a gasket 66 formed of a flexible, dielectric material. Both the swirl plate 64 and gasket 66 are formed with a throughbore to receive the pin 52 connected to the inductor plate 48.

Considering first the delivery of waterborne pesticide to the inductor ring 48, a central bore 68 is formed in the swirl plate 64 in axial alignment with the liquid passageway 24 which tapers radially inwardly from the top surface 70 of swirl plate 64 to its bottom surface 72. The central bore 68 terminates at a nozzle tip 74 having an outlet 75 which extends outwardly from the bottom surface 72 of swirl plate 64 and approximately midway into the aperture 50 of the inductor plate 48 beneath. Waterborne pesticide introduced into the liquid passageway 24 flows through a strainer 76 having a check valve (not shown), into the central bore 68 of swirl plate 64 and then through the outlet 75 in the nozzle tip 74 into the aperture 50 of inductor plate 48. The strainer 76 is commercially available from Spraying Systems Company of Wheaton, Ill. under Part No. 4193A.

In order to control the flow of waterborne pesticides supplied through the liquid passageway 24, an orifice plate 78 having a metering orifice 80 is positioned between the strainer 76 and the nozzle tip 74 atop an annular shoulder 82 formed in the central bore 68. The orifice plate 78 functions to meter the flow of waterborne pesticide from the liquid passageway 24, and directs a stream of waterborne pesticide toward the nozzle tip 74. A turbulence pin 84 is mounted to the walls of the swirl plate 64 within the central bore 68, substantially transverse to the orifice 80 in orifice plate 78, to deflect the waterborne pesticide stream emitted through the orifice 80. This pin helps reduce the velocity of such stream and induces turbulence in the stream so that it can be properly atomized and electrostatically charged as described in detail below. The orifice plate 78 is commercially available from Spraying Systems Company under Part No. 4916-16. Preferably, the atomization takes place within the aperture 50 of inductor plate 48 where the stream is discharged from the outlet 75 of nozzle tip 74.

Figure 3:
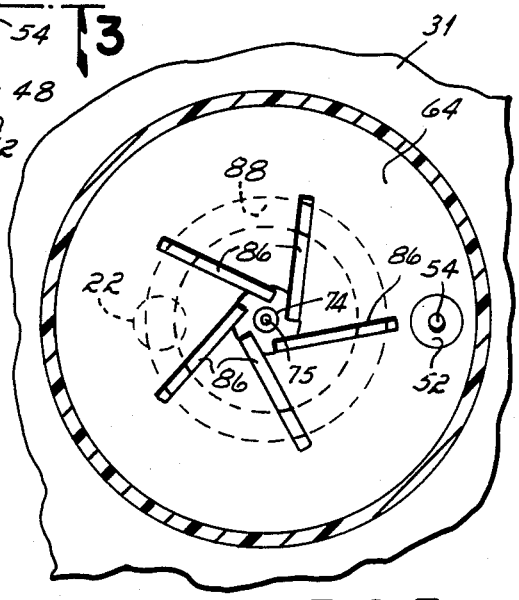
FIG. 3 is a cross sectional view taken generally along line 3—3 of FIG. 1 showing the bottom surface of the swirl plate of this invention.

Referring to FIG. 3, atomization of the waterborne pesticide stream is achieved by a plurality of channels 86 formed in the swirl plate 64. The channels 86 extend along the bottom surface 72 of swirl plate 64 and taper downwardly from an annular groove 88 formed in the upper portion 70 of swirl plate 64 to the central bore 68. Annular groove 88 communicates with the air passageway 22. Each tapered channel 86 decreases in cross section from the annular groove 88 to the central bore 68.

Preferably, the channels 86 are formed along axes which are substantially tangent to the central bore 68 and the outlet 75 of the nozzle tip 74. Each of the channels 86 therefore defines a flow path for the air supplied by air passageway 22 which is substantially tangent to the outlet 75 of nozzle tip 74. The channels 86 thus produce a swirling, essentially spiral-shaped flow of air which is accelerated from the annular groove 88 toward the nozzle tip 74, due to the tapered shape of the channels 86. This accelerating flow of air reaches the point of maximum geometric constriction, and therefore maximum velocity in the space between nozzle tip 74 and aperture 50 of inductor ring 48. With the accelerating swirling air stream reaching maximum velocity at outlet end 75 of nozzle tip 74, atomization of the waterborne stream of pesticide as it is ejected from the outlet end 75 is most optimally achieved to form discrete, finely divided droplets or particles. The air streams from channels 86 impart the same swirling, substantially spiral motion to the atomized particle stream.

Figure 2:
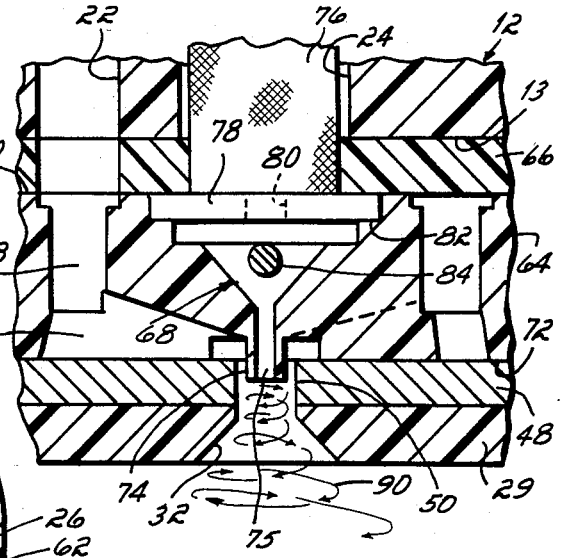
FIG. 2 is an enlarged view in partial cross section of a portion of the nozzle assembly shown in FIG. 1.

Charging of the waterborne pesticide stream occurs within the aperture 50 of the inductor ring 48. It is believed that the leading end of the waterborne pesticide stream ejected from the nozzle tip 74 is subjected to the electrostatic field created by the inductor ring 48 which has a sufficiently intense negative charge to drive the electrons in the stream back through the stream to ground. This process is enabled by the fact that the pesticide stream is conductive and is itself grounded through the pesticide column leading back to the grounded supply tank (not shown). With the free electrons driven back towards ground and away from the terminal end of the pesticide stream in the nozzle tip 74, the leading end of the stream has an overall positive charge. The leading end of the waterborne pesticide stream is then atomized by the swirling air stream from channels 86 forming finely divided particles having a positive charge, or, of a polarity opposite to that of the inductor ring 48. The charged particles are then discharged through the discharge orifice 32 of air nozzle 28 for deposition upon row crop or other plant to be coated with pesticide. Because the charged particle stream of pesticide is entrained within a swirling stream of air, it tends to continue the spiral or swirling motion after discharge from the discharge orifice 32. This swirling motion causes the particle stream to quickly fan radially outwardly from the discharge orifice 32 to form a wide spray pattern 90 which ensures coverage of the plants to be coated. See FIG. 2.

In another aspect of this invention, the air stream produced by the channels 86 of swirl plate 64 form a high velocity air barrier between the inductor plate 48 and the stream of waterborne pesticide. This is important, because the inductor ring 48 must be maintained at its full electrical potential to most efficiently impart an electrostatic charge upon the particles. If the stream of waterborne pesticide, which is held at ground potential, was permitted to wet the surface of inductor ring 48, a conductive path from the inductor ring 48 to ground through the pesticide stream and grounded supply tank could be created which would ground the inductor ring 48 and render it ineffective in charging the atomized particle stream. The barrier of air created by the channels 86 of swirl plate 64 effectively prevents the waterborne pesticide from wetting the surface of the inductor plate 48 and therefore greatly enhances its charging efficiency.

The charged particles emitted from the discharge orifice 32 of air nozzle 28 are propelled toward a target plant by the air stream supplied from the air passageway 22. During normal operating conditions, it is possible that at least a portion of the charged particles will collect upon the inner surface 38 and the outer surface 42 of the annular wall 36 of air nozzle 28. The charged particles will tend to migrate along the wall 36 and the outer wall 15 of nozzle body 12 toward the grounded support bracket 16 due to the electrostatic attraction therebetween.

Such migration of charged particles is resisted by the air nozzle 28 of this invention in two respects. First, the inner surface 38 of annular wall 36 is formed in a generally conical shape. It has been found that such shape tends to collect charged particles due to the lines of the electric field produced by the charged particles as they are emitted from the discharge orifice 32. The charged particles collected on the inner surface 38 of annular wall 36 simply drip away instead of migrating to the outer surface 42 of wall 36.

Additionally, an electrical standoff is provided by the irregular-shaped outer surface 42 of the annular wall 36 and the nozzle nut 30 between the inductor ring 48 and the grounded bracket 16. The recesses and ridges formed by grooves 40, and the radial flange 31 of nozzle nut 30, tend to disrupt the flow of particles along the electric field produced by the charged particles emitted from the discharge orifice 32 which lengthens the electrical path between the discharge orifice 32 and the grounded bracket 16. In addition, the grooves 40 and radial flange 31 lengthen the physical and electrical path along which charged particles would have to move in order to migrate along the outer surface 42 of air nozzle 28 toward the grounded bracket 16. The electrical and physical paths created by such grooves 40 and radial flange 31 is effectively electrically lengthened without physically increasing the length of the air nozzle 28. This substantially eliminates the possibility of grounding the inductor ring 48 which would greatly reduce its efficiency in charging the waterborne pesticide stream.

In addition to all of the advantageous aspects of the invention hereinbefore described, it will be appreciated that these advantages are provided by a spray nozzle structure which comprises a multiple component assembly which is most easily assembled and disassembled for maintenance and repair, or replacement of worn or defective parts. Nut 30 is threadedly secured to the nozzle body 12 and engages the air nozzle 28 to compressibly retain it against nozzle body 15 through the compression of the interspaced resilient sealing gasket 66. Inductor ring 48 and swirl plate 64 are housed within air nozzle 28 and these two components are thereby also compressibly retained against seal gasket 66 and nozzle body 15 as shown in FIG. 1. Swirl plate 64 supports turbulence pin 89 and orifice plate 78, and strainer/check valve 76 is supported on orifice plate 78 as previously described. This assembly is easily assembled and can be easily disassembled for cleaning, replacement, or repair of any of those components.

While the invention has been described with reference to a preferred embodiment, it will be understood by those skilled in the art that various changes may be made and equivalents may be substituted for elements thereof without departing from the scope of the invention. In addition, many modifications may be made to adapt a particular situation or material to the teachings of the invention without departing from the essential scope thereof. Therefore, it is intended that the invention not be limited to the particular embodiment disclosed as the best mode contemplated for carrying out this invention, but that the invention will include all embodiments falling within the scope of the appended claims.

What is claimed is:

1. An electrostatic nozzle assembly for coating objects comprising:

a nozzle body having an air passageway adapted to receive a stream of air and a liquid passageway adapted to receive a stream of liquid;

an air nozzle mounted to said nozzle body, said air nozzle being formed with a discharge orifice;

an inductor ring formed with an aperture, said inductor ring being mounted between said nozzle body and said air nozzle so that said aperture axially aligns with said discharge orifice;

charging means for applying an electrical potential to said inductor ring;

means communicating with said liquid passageway for directing the stream of liquid into said aperture of said inductor ring;

means communicating with said air passageway for imparting a swirling, rotational motion to the stream of air, said swirling stream of air being directed into contact with the liquid stream to form finely divided particles within said aperture of said inductor ring, said particles becoming inductively charged by said inductor ring and entrained within said swirling stream of air for discharge upon the object to be coated, and comprising a swirl plate mounted between said nozzle body and said inductor ring, said swirl plate being formed with a central bore and a plurality of channels communicating with said air passageway for receiving the stream of air therefrom, each of said channels extending radially outwardly from said central bore along an axis substantially tangent thereto, said channels imparting a swirling, rotational motion to the stream of air with respect to the axis of said central bore.

2. The electrostatic nozzle assembly of claim 1 in which said swirl plate is formed with a top surface and a bottom surface facing said inductor plate, said channels extending inwardly from said bottom surface toward said top surface.

3. The electrostatic nozzle assembly of claim 2 in which said central bore of said swirl plate tapers radially inwardly from said top surface to a reduced diameter nozzle tip having an outlet end extending outwardly from said bottom surface.

4. The electrostatic spray nozzle assembly of claim 3 in which said outlet end of said nozzle tip extends into said aperture of said inductor ring forming a space therebetween in the path of the air stream produced by said swirl plate, said space forming a point of maximum constriction of the air stream to thereby obtain maximum velocity of the air stream thereat.

5. The electrostatic nozzle assembly of claim 4 in which said central bore of said swirl plate communicates with said liquid passageway for receiving said stream of liquid, said liquid stream being discharged from said outlet end of said nozzle tip into said aperture of said inductor ring, said channels of said swirl plate decreasing in cross section from said annular groove to said nozzle tip and thereby accelerating the air stream toward said nozzle tip, said point of maximum constriction of the air stream being positioned at said outlet end of said nozzle tip to achieve maximum velocity of the air stream thereat for optimizing the atomization of the liquid stream discharged from said outlet end of said nozzle tip into said aperture of said inductor ring.

6. The electrostatic nozzle assembly of claim 3 further including:

an orifice disc mounted between said nozzle body and said swirl plate, said orifice disc being formed with a metering orifice disposed in alignment with said central bore of said swirl plate;

a pin mounted to said swirl plate substantially transverse to the axis of said metering orifice;

said orifice disc communicating with said liquid passageway for transmitting the liquid stream through said metering orifice, the liquid stream discharged from said metering orifice being directed into engagement with said pin.

7. An electrostatic nozzle assembly for coating objects comprising:

a nozzle body formed with an air passageway adapted to receive a stream of air and a liquid passageway adapted to receive a stream of liquid;

a grounded support for said nozzle body;

an air nozzle mounted to said nozzle body, said air nozzle being formed with a discharge orifice and an annular wall extending outwardly from said discharge orifice defining a cavity, said annular wall being formed with an inner surface and an irregularly-shaped outer surface spaced from said support means;

an inductor ring formed with an aperture, said inductor ring being mounted between said nozzle body and said air nozzle so that said aperture axially aligns with said discharge orifice;

charging means connected to said nozzle body for applying an electrical potential to said inductor ring;

means communicating with said liquid passageway for directing the stream of liquid into said aperture of said inductor ring;

means communicating with said air passageway for directing the stream of air into contact with the liquid stream to form finely divided particles, said particles becoming inductively charged by said inductor ring and entrained with the stream of air for discharge through said discharge orifice and cavity of said air nozzle onto the object to be coated; and a nozzle nut having a radial flange for mounting said air nozzle to said nozzle body, said nozzle nut being disposed between said discharge orifice and said grounding means so that said radial flange forms an extended path of migration of said inductively charged particles from said discharge orifice to said grounded support means.

8. The electrostatic nozzle assembly of claim 7 in which said annular wall is formed with a plurality of grooves extending from the exterior of said annular wall inwardly forming said irregularly-shaped outer surface with a plurality of ridges and recesses, said ridges and recesses of said irregularly-shaped outer surface forming an extended path of migration of said inductively charged particles from said discharge orifice to said grounded support means.

9. The electrostatic nozzle assembly of claim 8 in which said inner surface of said annular wall of said air nozzle is formed in a generally conical shape which increases in cross section from said discharge orifice outwardly.

10. An electrostatic nozzle assembly for coating objects comprising:

a nozzle body member having an air passageway adapted to receive a stream of air, a liquid passageway adapted to receive a stream of liquid, and an electrical passageway adapted to receive an electrical conduit means;

a swirl plate member positioned adjacently to said nozzle body member, said swirl plate member having a central bore and a plurality of channels communicating with said air passageway for receiving the stream of air therefrom, each of said channels extending radially outwardly from said central bore along an axis substantially tangent thereto, said channels imparting a swirling, rotational motion to the stream of air with respect to the axis of said central bore;

an inductor ring member formed with an aperture, said inductor ring member being substantially disc-shaped and being positioned adjacent said swirl plate;

an air nozzle member formed with a discharge orifice, said air nozzle member being positioned adjacent said inductor ring;

charging means for applying an electrical potential through said electrical conduit means in said electrical passageway to said inductor ring; and releasable securing means for releasably securing said swirl plate adjacent to said nozzle body, said inductor member adjacent to said swirl plate, and said air nozzle adjacent to said inductor member, whereby said central bore of said swirl plate, said aperture of said inductor ring, and said discharge orifice of said air nozzle are in an aligned position.

11. The electrostatic nozzle assembly of claim 10 further including a pin secured to said inductor member, said pin projecting through an aperture formed in said swirl plate member and into said electrical passageway of said nozzle body to form an electrical connection between said electrical conduit means in said electrical passageway of said nozzle body and said inductor member.

12. The electrostatic nozzle assembly of claim 10 wherein the exterior surface of said nozzle body is formed with external threads, said releasable securing means comprising an internally threaded nut member, said nut member engaging the exterior surface of said air nozzle, said inductor ring and said swirl plate being supported in said air nozzle, said internally threaded nut member being threadedly engageable with said external threads of said nozzle body to releasably secure said swirl plate, said inductor member, and said air nozzle, to said nozzle body.

13. The electrostatic nozzle assembly of claim 10 further including a grounded support for said nozzle body, said air nozzle being formed with an annular wall disposed outwardly from said discharge orifice, said annular wall having an outer surface, a plurality of grooves extending from said outer surface; and wherein said nut member has a radial flange, said grooves of said outer surface of said air nozzle and said radial flange of said nut member providing electrical isolation between said inductor ring and said grounded support.

14. The electrostatic nozzle assembly of claim 10 wherein said central bore of swirl plate member terminates in a nozzle tip having an outlet end, said outlet end being aligned with said aperture of said inductor ring and said discharge orifice of said air nozzle.

15. The electrostatic nozzle assembly of claim 14 wherein said nozzle tip aligns with said liquid passageway in said nozzle body and wherein an orifice plate is positioned between said liquid passageway and said nozzle tip, said orifice plate having an orifice which aligns with said aperture of said nozzle tip, further including a turbulence pin mounted transversely with respect to said orifice of said orifice plate, said turbulence pin being located between said orifice plate and said nozzle tip.

16. The electrostatic nozzle assembly of claim 10 further comprising a compressible fluid sealing member positioned between said swirl plate member and said nozzle body, said releasable securing means compressing said sealing member to provide fluid seals at the outlets of said air passageway and said liquid passageway, and to provide positive contact between said air nozzle and said inductor ring, and said inductor ring and said swirl plate.

* * * * *